United States Patent [19]

Stronach

[11] Patent Number: 4,785,598

[45] Date of Patent: Nov. 22, 1988

[54] WALL PANEL ASSEMBLIES

[75] Inventor: Frank Stronach, Newmarket, Canada

[73] Assignee: Magna International Inc, Markham, Canada

[21] Appl. No.: 439,674

[22] Filed: Nov. 8, 1982

[30] Foreign Application Priority Data

Aug. 11, 1982 [CA] Canada ..... 409,197

[51] Int. Cl.[4] ..... E04H 1/00

[52] U.S. Cl. ..... 52/238.1; 52/239; 52/584

[58] Field of Search ..... 52/262, 582, 584, 811, 52/239, 770, 771, 282, 727; 403/170, 173, 174, 178, 205

[56] References Cited

U.S. PATENT DOCUMENTS

| | | | |
|---|---|---|---|
| 1,548,083 | 8/1925 | Young et al. | 52/282 X |
| 1,813,873 | 7/1931 | Brogden | 52/727 X |
| 2,097,484 | 11/1937 | Winslow | 52/584 |
| 2,187,148 | 1/1940 | Fisher | 52/262 |
| 2,662,252 | 12/1953 | Styles | 52/282 |
| 2,797,448 | 7/1957 | Revell et al. | 52/811 |
| 3,886,699 | 6/1975 | Bergmann, Jr. | 52/582 X |

*Primary Examiner*—Carl D. Friedman
*Assistant Examiner*—Creighton Smith
*Attorney, Agent, or Firm*—Robert F. Delbridge; Arne I. Fors

[57] ABSTRACT

A wall panel assembly has a pair of co-planar panels with adjacent spaced end edges. A first partial column member extends substantially the height of the panels on one side and also extends transversely across the space between the panels. The first column member has transversely extending flanges each secured to a respective panel on one side. A second partial column member extends for substantially the height of the panels on the opposite side and also extends transversely across the space between the panels. The second column member has transversely extending flanges each secured to a respective panel on the opposite side to form a hollow column with the first column member and the adjacent spaced end edges of the panels.

2 Claims, 4 Drawing Sheets

Figure 1:
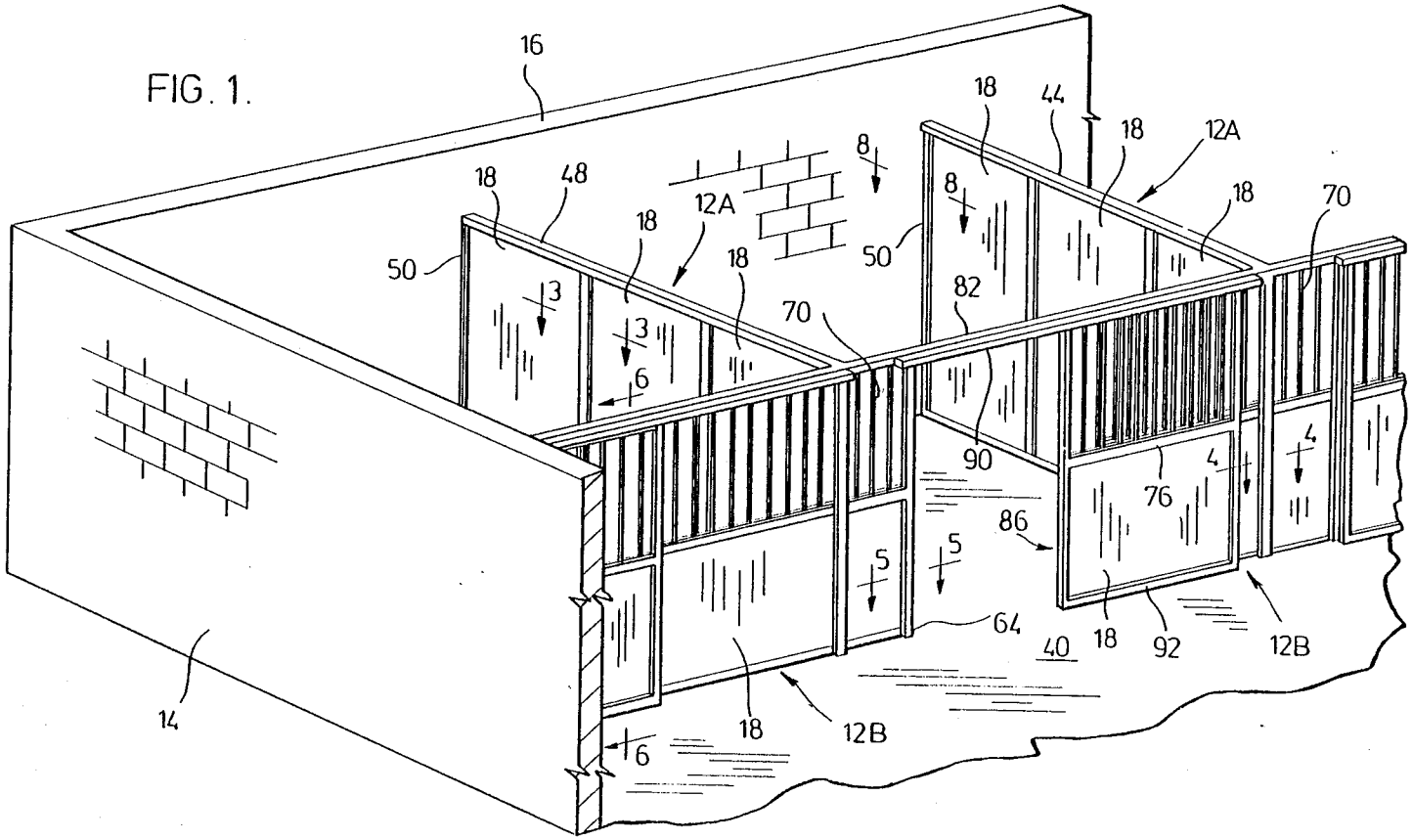

FIG. 3.
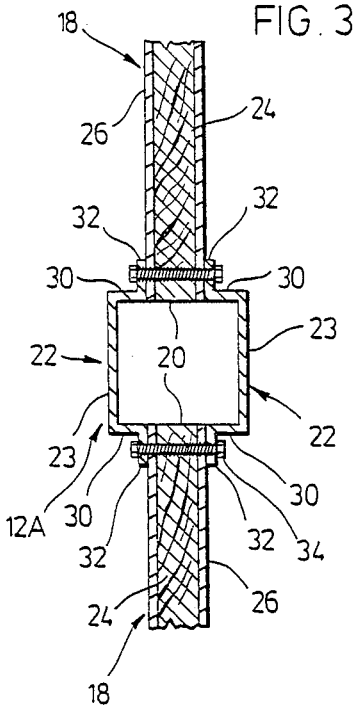
FIG. 4.
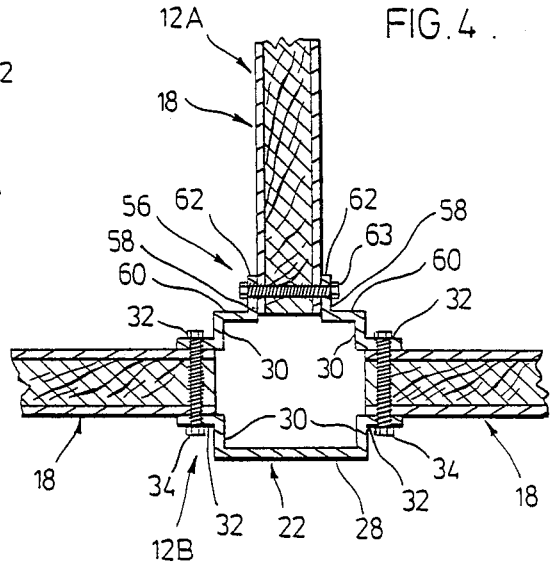
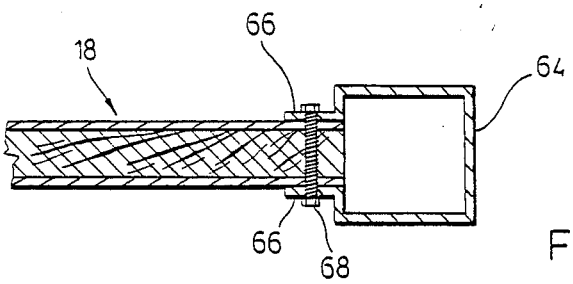
FIG. 5.

FIG. 6.
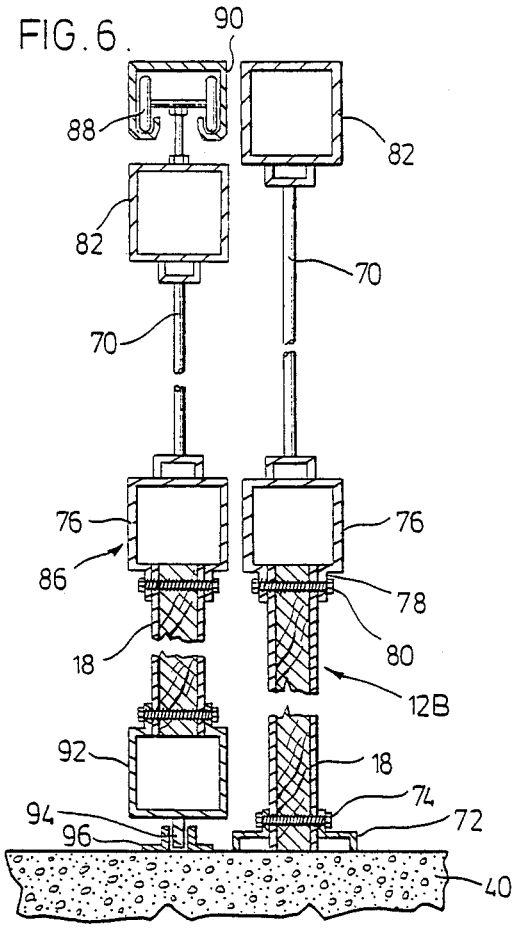
FIG. 7.
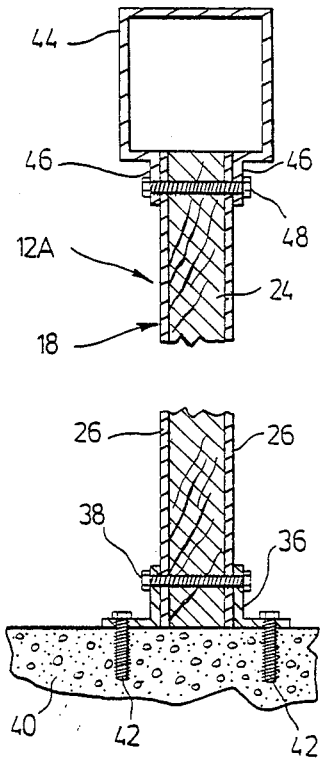
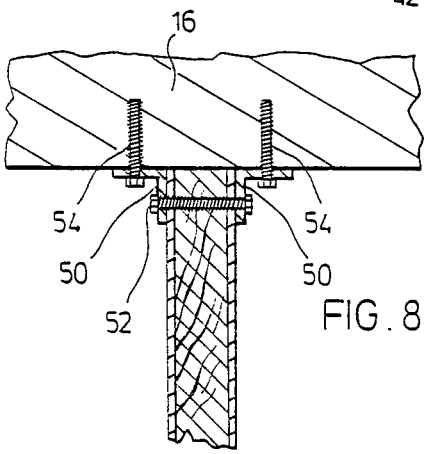
FIG. 8.

WALL PANEL ASSEMBLIES

This invention relates to wall panel assemblies.

There is frequently a need for wall panel assemblies which are of sturdy, simple and inexpensive construction, and which can be easily installed and also removed when necessary. Stalls for horses are one example in which wall panel assemblies having such criteria are required.

According to the present invention, a wall panel assembly comprises a pair of co-planar panels having adjacent spaced end edges, a first partial column member extending substantially the height of the panels on one side thereof and also extending transversely across the space therebetween, the first column member having transversely extending flanges each secured to a respective panel on said one side thereof, and a second partial column member extending for substantially the height of the panels on an opposite side thereof and also extending transversely across the space therebetween, the second column member having transversely extending flanges each secured to a respective panel on said opposite side and the adjacent spaced end edges of the panels.

Such wall panel assemblies can be readily installed and also removed if necessary, and are suitable for use in constructing horse stalls and other installations requiring the criteria mentioned above.

Each partial column member may comprise a main portion extending transversely across the space between the panel and outwardly spaced from the respective side thereof, and intermediate portions extending from opposite ends of the main portion to the transversely extending flanges. The main portion of each partial column member may be substantially parallel to the transversely extending flanges, and the intermediate portions may be substantially perpendicular to the main portion and the transversely extending flanges.

Each panel may comprise a wooden panel member and sheet metal panel members on opposite sides thereof, with the assembly also including securing means passing through the flanges of the first partial column member, through the sheet metal panel members and the wooden panel member of the respective panels and through the flanges of the second partial column member to secure the first and second column members to the panels.

One of the partial column members may comprise two column member sections, each column member section having a respective one of the transversely extending flanges of the column member and a further flange extending in spaced parallel relationship to the further flange of the other column member section, and an end edge of a third panel extending between and secured to said further flanges.

Wall panel assemblies in accordance with the invention have various uses. For example, they may be used to form a freestanding room or stall structure within a building, they may be used in conjunction with one or more walls of other constructions to form a room or stall structure, or they be used to form the exterior walls and interior subdividing walls of a building, with a suitable roof structure being supported by at least the columns formed by the first and second partial column members of the exterior wall panel assemblies.

Figure 2:
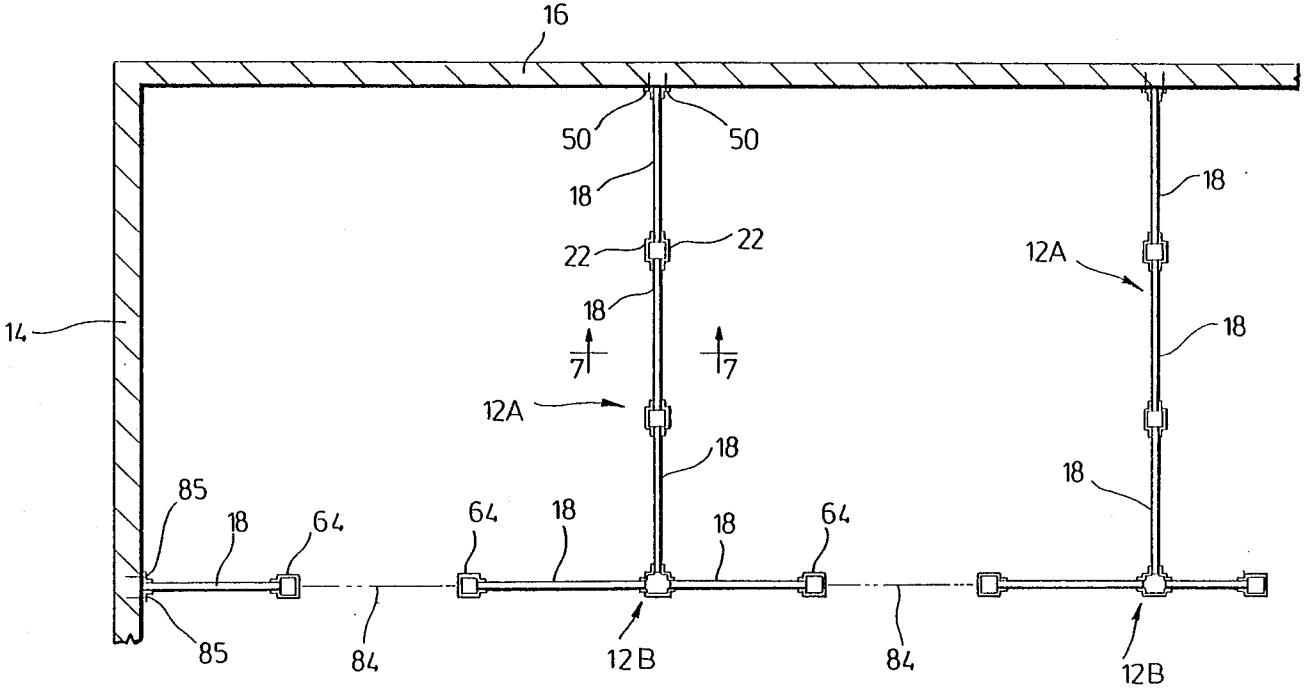

One embodiment of the invention will now be described, by way of example, with reference to the accompanying drawings, of which:

FIG. 1 is a perspective view of a horse stall construction formed by wall panel assemblies in accordance with one embodiment of the invention used in conjunction with walls of another construction, FIG. 2 is a sectional plan view of an end part of the horse stall construction of FIG. 1, the sliding stall doors being omitted for clarity, FIG. 3 is a sectional view along the line 3—3 of FIG. 1, FIG. 4 is a sectional view along the line 4—4 of FIG. 1, FIG. 5 is a sectional view along the line 5—5 of FIG. 1, FIG. 6 is a sectional view along the line 6—6 of FIG. 1, FIG. 7 is a sectional view along the line 7—7 of FIG. 2, and FIG. 8 is a sectional view along the line 8—8 of FIG. 1.

Referring to the drawings, a horse stall construction is formed by wall panel assemblies 12A, 12B in accordance with one embodiment of the invention used in conjunction with two mutually perpendicular walls 14, 16 of a building.

Each wall panel assembly 12A forms a partition separating adjacent horse stalls, and comprises three co-planar panels 18 having adjacent spaced end edges 20 (see FIG. 3) and first and second partial column members 22. Each panel 18 is formed by a central plywood panel member 24 with steel sheets 26 bonded thereto on opposite sides thereof. Each partial column member 22 is of galvanized steel and has a main portion 28 extending across the space between the end edges 20 of adjacent panels 18 in outwardly spaced parallel relationship to one side of the panels 18, intermediate portions 30 extending perpendicularly from opposite ends of the main portion 28 toward the panels 18, and transversely extending flanges 32 extending perpendicularly outwardly from the intermediate portions 30.

Each adjacent pair of panels 18 is connected by a first partial column 22 located on one side of the panels 18 with its transversely extending flanges 32 engaging the respective panels 18 at the ends 20, and by a second partial column member 22 similarly located on the opposite side of the panels 18. Transversely extending flanges 32 are secured to the panels 18 by bolts 34 which each pass through a flange 32 of the first partial column member 22, the steel sheets 26 and central plywood panel member 24 of the respective panel 18, and a flange 32 of the second partial column member 22. The two partial column members 22 thus co-operate with the ends 20 of the panels 18 to form a hollow column.

As shown in FIG. 7, angle bars 36 extend along opposite sides of each wall panel assembly 12A at the bottom thereof, the angle bars 36 being secured to the panels 18 by bolts 38 and to a concrete floor 40 of the building by anchor bolts 42. Also, a hollow beam 44 extends along the top of the panels 18 and column members 22, the beam 44 having downwardly extending spaced flanges 46 receiving the upper ends of the panels 18 and being secured thereto by bolts 48 passing through the flanges 46 and panels 18. As shown in FIG. 8, each edge of the panel 18 adjacent the wall 16 is secured thereto by angle bars 50 extending down opposite sides of the panel 18, the angle bars 15 being secured to the panel 18 by bolts 52 and to the wall 16 by anchor bolts 54.

Each wall panel assembly 12B (see especially FIG. 4) forms part of the front wall of each horse stall and comprises two co-planar panels 18 and a third panel 18 which is part of an adjacent wall panel assembly 12A. On the outer side, the co-planar panels 18 are connected by first partial column member 22 and are connected on the inner side by a second partial column member 56. The second partial column member 56 comprises two column member sections 58, each having a short main portion 60 with a perpendicular intermediate portion 30 and a transversely extending flange 32. At the opposite end of the main portion 60 to the intermediate portion 30, a further flange 62 extends perpendicularly to the main portion 60 in the opposite direction to the intermediate portion 30. The end edge of the panel 18 of the wall panel assembly 12A extends between the flanges 62 and is secured thereto by bolts 63 passing through the flanges 62 and the end edge of the panel 18. The two column member sections 58 and the end edge of the panel 18 therefore form a second partial column member 56.

A hollow column 64 (see FIG. 5) is located at each free end of the co-planar panels 18 of a wall panel assembly 12B, one side of the column 64 having laterally extending spaced flanges 66 receiving the free end of the respective panel 18 and being secured thereto by bolts 68. In the wall panel assemblies 12B, the panels 18 only extend over the lower part with a grill 70 being provided in the upper part. The bottoms of the panels 18 are secured to the floor 40 by angle bars 72 and bolts 74. A hollow beam 76 extends across the top of the panels 18 and has downwardly extending flange 78 on opposite sides of the panels and bolted thereto by bolts 80, with the grill 70 being mounted on top of the beam 76. A hollow beam 82 also extends across the top of the grill 70, column members 22, 56 and columns 64.

As shown in FIG. 2, each set of wall panel assemblies 12A 12B form a T-shaped wall structure. With the exception of the end horse stall, each horse stall has a rear wall formed by the wall 16, side walls formed by a wall panel assembly 12A and a front wall formed by panels 18 of adjacent wall panel assemblies 12B, the last mentioned panels 18 being spaced from one another to provide an entrance opening 84 with the beam 82 extending thereacross. The end horse stall has one side wall formed by the wall 14, and part of the front wall formed by a panel 18 secured to the wall 14 by angle bars 85 and associated bolts, but in other respects similar to one of the co-planar panels 18 of a wall panel assembly 12B.

Referring now to FIG. 6, a sliding door 86 is mounted to slide to and fro across the opening 84. The door 86 has rollers 88 at the top mounted in a track beam 90 r secured to the beam 82 at appropriate positions. The door 86 is constructed in a similar manner to the front walls of the horse stalls, the door 86 having top beam 82, grill 70, beam 76 and panel 18, with a lower hollow beam 92 having a downwardly extending projection 94 guided between angle bars 96 secured to the floor 40.

The advantages of the present invention will be readily apparent from the above description of one embodiment since a person skilled in the art will readily appreciate that the described horse stall construction is sturdy, simple and inexpensive, and is easily installable and removable if necessary. It will also be noted that electrical wiring or other facilities may be readily passed through the hollow columns during construction, or after construction by removing one of the column members.

Also, instead of using two walls of a building, horse stalls may have all four walls constructed with panel assemblies in accordance with the invention. Such a structure may be a freestanding structure within a building, and the arrangement may be such that a circumferential internal horse walking area is provided around the stall structure within the building. Alternatively, wall panel assemblies in accordance with the invention may form the exterior wall Further, instead of the wall panel assemblies being used as side walls as described and illustrated, they may walls.

Other embodiments of the invention will be readily apparent to a person skilled in the art, the scope of the invention being defined in the appended claims.

What I claim as new and desire to protect by Letters Patent of the United States is:

1. A wall panel assembly in a building having a floor and walls, said panel assembly comprising a pair of co-planar panels having adjacent spaced end edges, opposite end edges secured to respective walls and lower edges secured to the floor, a first partial column member extending upwardly from the floor to substantially the height of the panels on one side thereof and also extending transversely across the space therebetween, a second partial column member extending upwardly from the floor to substantially the height of the panels on an opposite side thereof and also extending transversely across the space therebetween, each partial column member comprising a main portion extending transversely across the space between the panels and outwardly spaced from the respective side thereof, and intermediate portions extending from opposite ends of the main portion to transversely and outwardly extending flanges overlying the panels, the main portion of each partial column member being substantially parallel to the transversely extending flanges, and the intermediate portions being substantially perpendicular to the main portion and the transversely extending flanges, first removable bolt means passing through one flange of the first column member, one of the panels and one flange of the second column member to secure the column members to said one panel, and second removable bolt means passing through the other flange of the first column member, the other panel and the other flange of the second column member to secure the column members to the other panel, with the first and second column members forming a vertical hollow column with the adjacent spaced end edges of the panels, said vertical hollow column containing no structural support member.

2. A wall panel assembly according to claim 1 wherein one of the partial column members comprises two column member sections, each column member section having a respective one of the transversely extending flanges of the column member and a further flange extending in spaced parallel relationship to the further flange of the other column member section, and end edge of a third panel extending between said further flanges, and third removable bolt means passing through said further flange of one column member section, the third panel and said further flange of the other column member section to secure said column member third panel, said third panel also having an opposite end edge secured to a wall and a lower edge secured to the floor.

* * * * *